US005876250A

United States Patent [19]

Deng

[11] Patent Number: 5,876,250

[45] Date of Patent: Mar. 2, 1999

[54] PLUG WITH IMPROVED ARRANGEMENT FOR ACCOMMODATING A FUSE

[76] Inventor: C. C. Deng, No. 1 Alley 50, Lane 305, Sec. 3 Chung-Shan Road, Tantze Hsiang, Taichung County, Taiwan

[21] Appl. No.: 893,135

[22] Filed: Jul. 15, 1997

[51] Int. Cl.[6] ..... H01R 13/68

[52] U.S. Cl. ..... 439/622

[58] Field of Search ..... 439/621, 622; 337/197, 198

[56] References Cited

U.S. PATENT DOCUMENTS 4,904,976 2/1990 Liaq ..... 439/622 X 5,435,755 7/1995 Chien et al. ..... 439/622

5,457,445 10/1995 Su ..... 439/622 X 5,791,941 8/1998 Wang ..... 439/622

*Primary Examiner*—Khiem Nguyen

*Attorney, Agent, or Firm*—Rosenberg, Klein & Bilker

[57] ABSTRACT

A plug includes a housing having an end face through which first and second blades extend. A fuse casing is mounted in the housing and includes a main casing body having an access defined in an upper side thereof through which a fuse is passable and a side opening defined in a side thereof, and a side lid is removably mounted to the side opening.

1 Claim, 4 Drawing Sheets

PLUG WITH IMPROVED ARRANGEMENT FOR ACCOMMODATING A FUSE

BACKGROUND OF THE INVENTION

1. Field of the Invention

The present invention relates to an improved plug of the type having a fuse therein and, more particularly, to a plug having an improved arrangement for accommodating a fuse.

2. Description of the Related Art

U.S. Pat. No. 4,738,639 to Henderson discloses an electric plug for accommodating two fuses. U.S. Pat. No. 4,968,269 to Urani et al. discloses a fuse holder for receiving a fuse. Both patents have limited application as they are different from typical plugs. U.S. Pat. No. 4,679,877 to Ahroni and U.S. Pat. No. 5,634,818 to Applicant both disclose a typical plug having a fuse received therein. A common disadvantage of both patents is that the fuse casing includes two half casing pieces which results in a complicated structure and thus is troublesome to manufacture and assemble. The present invention is intended to provide an improved design which mitigates and/or obviates the above problems.

SUMMARY OF THE INVENTION

A plug in accordance with the present invention comprises a housing having a first compartment defined therein. The housing includes an end face through which first and second blades extend. The end face further has an opening in communication with the compartment. A fuse casing is mounted in the first compartment and includes a main casing body having an access defined in an upper side thereof through which a fuse is passable and a side opening defined in a side thereof, and a side lid is removably mounted to the side opening. A periphery defining the side opening of the main casing body includes a recessed section with an inclined surface, and the side lid includes a complimentary inclined surface to fittingly engage with the inclined surface of the main casing body.

A first wire and a second wire are mounted in the housing, in which the second wire is in electrical connection with the second blade. In addition, a first conductive piece is mounted to the fuse casing and in electrical connection with the fuse and the first blade, and a second conductive piece is mounted to the fuse casing and in electrical connection with the fuse and the first wire. An upper lid is removably mounted to the end face to cover the opening.

Other objects, advantages, and novel features of the invention will become more apparent from the following detailed description when taken in conjunction with the accompanying drawings.

DESCRIPTION OF THE PREFERRED EMBODIMENT

Figure 1:
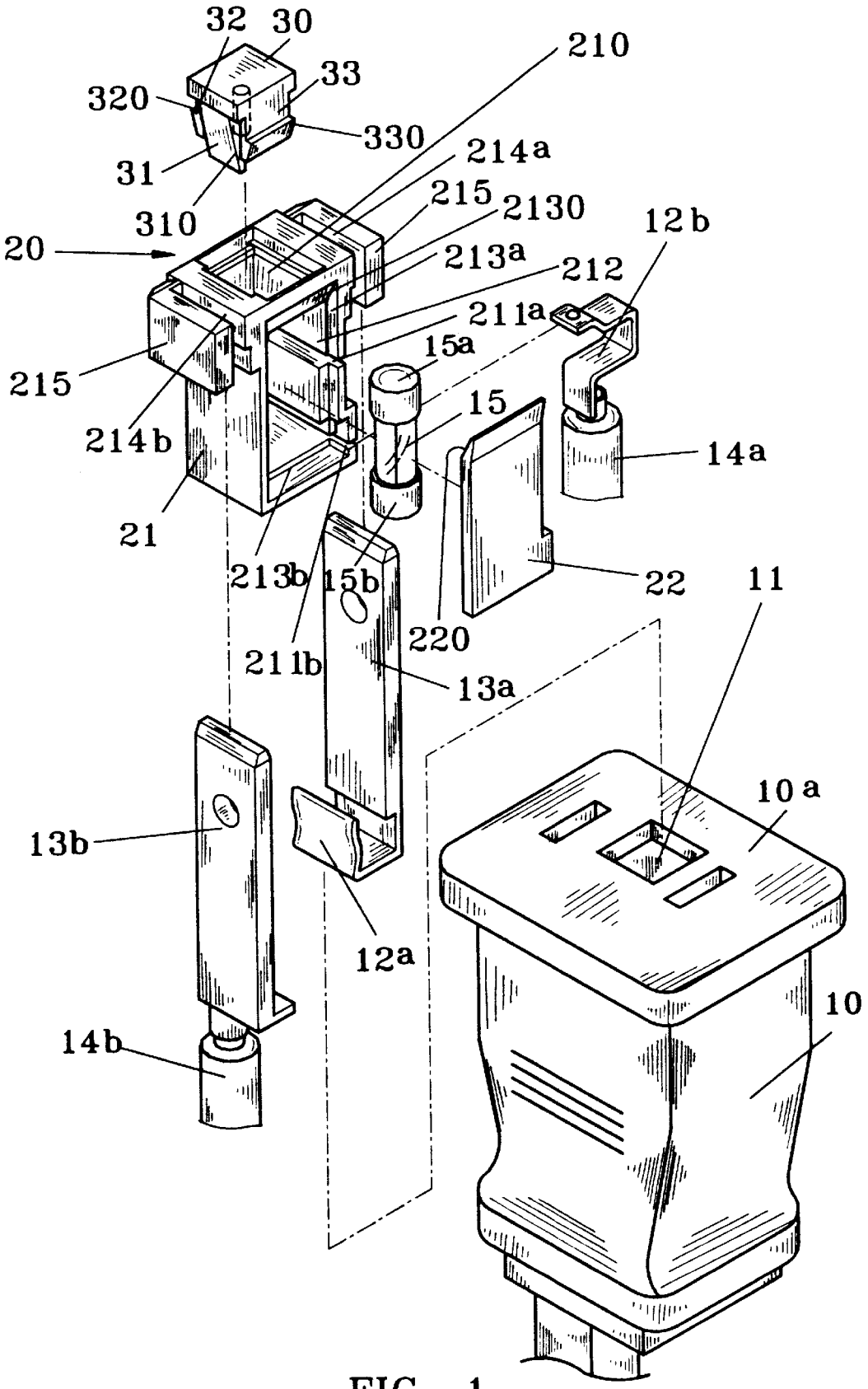
FIG. 1 is an exploded perspective view of a plug in accordance with the present invention.
Figure 4:
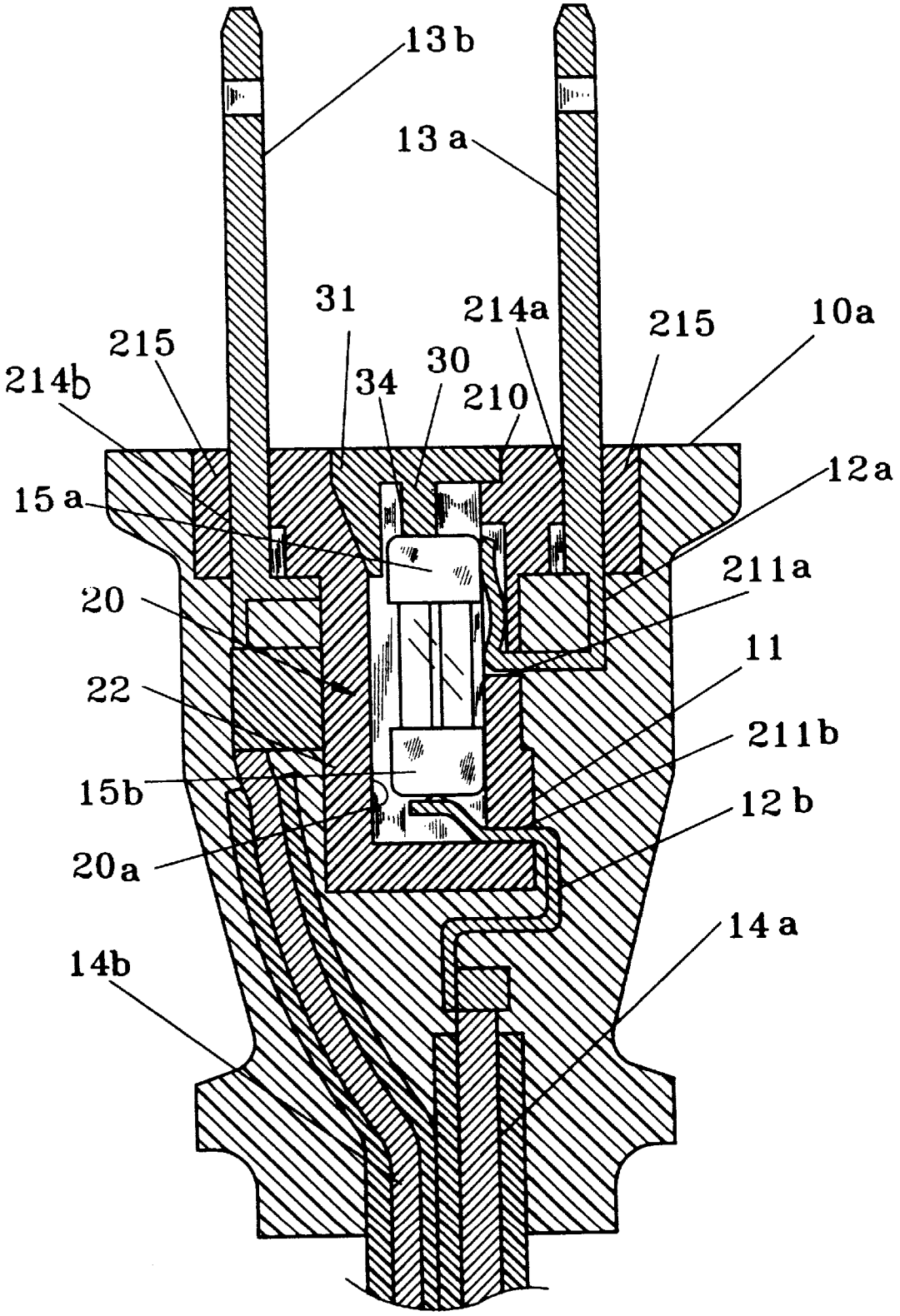
FIG. 4 is a cross sectional view of the plug in accordance with the present invention.

Referring to the drawings and particularly to FIGS. 1 and 4, a plug in accordance with the present invention includes a housing 10 including a compartment defined therein. The housing 10 includes an end face 10*a* through which first and second blades 13*a* and 13*b* extend and having opening 11 defined therein and in communication with the compartment of the housing 10. A fuse casing 20 is mounted in the compartment and has a second compartment 20*a* (FIG. 4) defined therein for receiving a fuse 15.

The fuse casing 20 includes a main casing body 21 having an access 210 defined in an upper side thereof through the fuse 15 is passable. The main casing body 21 further includes a side opening 212 (FIG. 1) defined in a side thereof, and a side lid 22 is removably attached to the main casing body 21 to close the side opening and form a part of the main casing body 21.

As shown in FIG. 4, the main casing body 21 includes a first guide duct 211*a* through which a first conductive piece 12*a* extends. In this embodiment, the first conductive piece 12*a* is integral with the first blade 13*a* and in electrical connection with a first conductive end 15*a* of the fuse 15. The main casing body 21 further includes a second guide duct 211*b* through which a second conductive piece 12*b* extends. The second conductive piece 12*b* is in electrical connection with a first wire 14*a* and a second conductive end 15*b* of the fuse 15. The main casing body 21 further includes two lateral wings 215 formed on two lateral sides thereof, thereby defining two passages 214*a* and 214*b* through which the blades 13*a* and 13*b* extend, respectively. The second blade 13*b* is in electrical connection with a second wire 14*b*.

Figure 2:
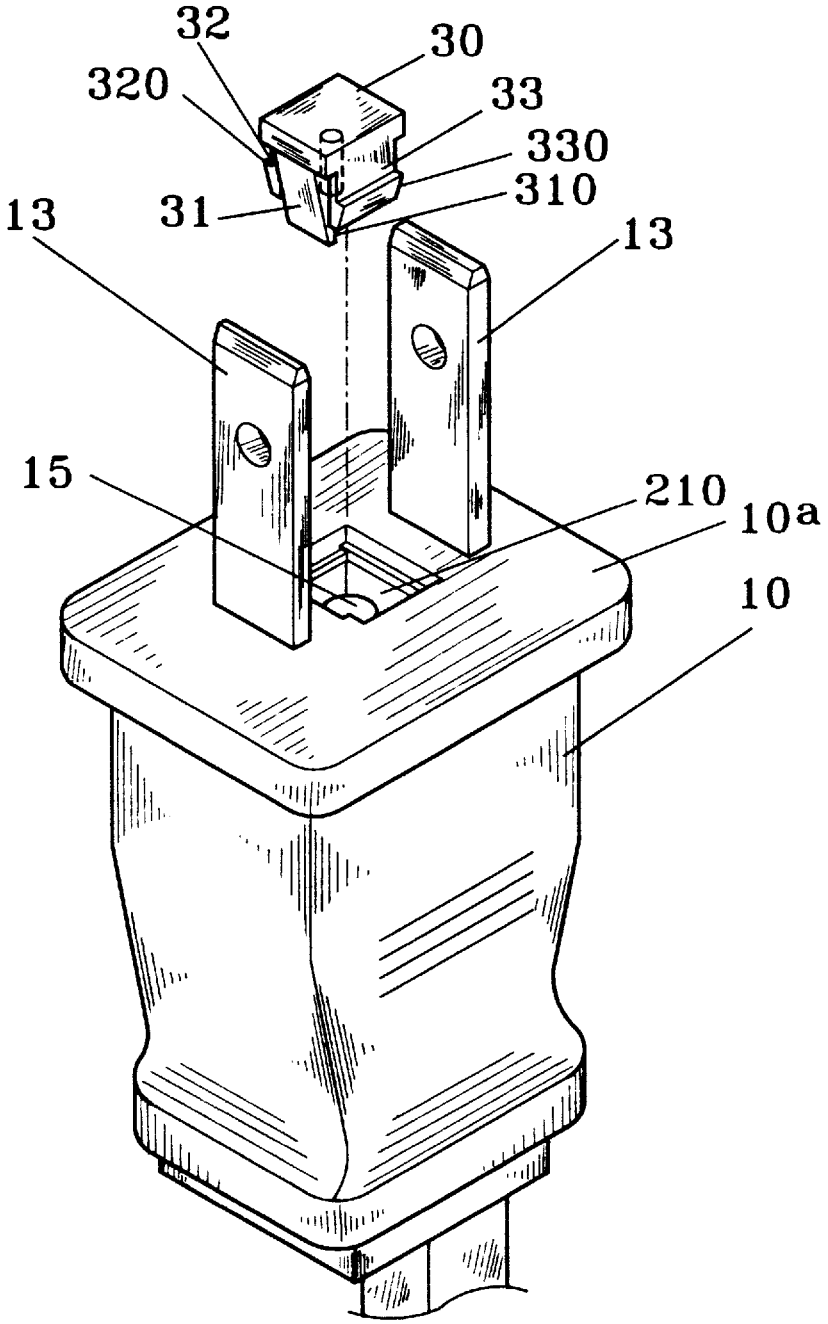
FIG. 2 is a perspective view, partly exploded, of a plug in accordance with the present invention.
Figure 3:
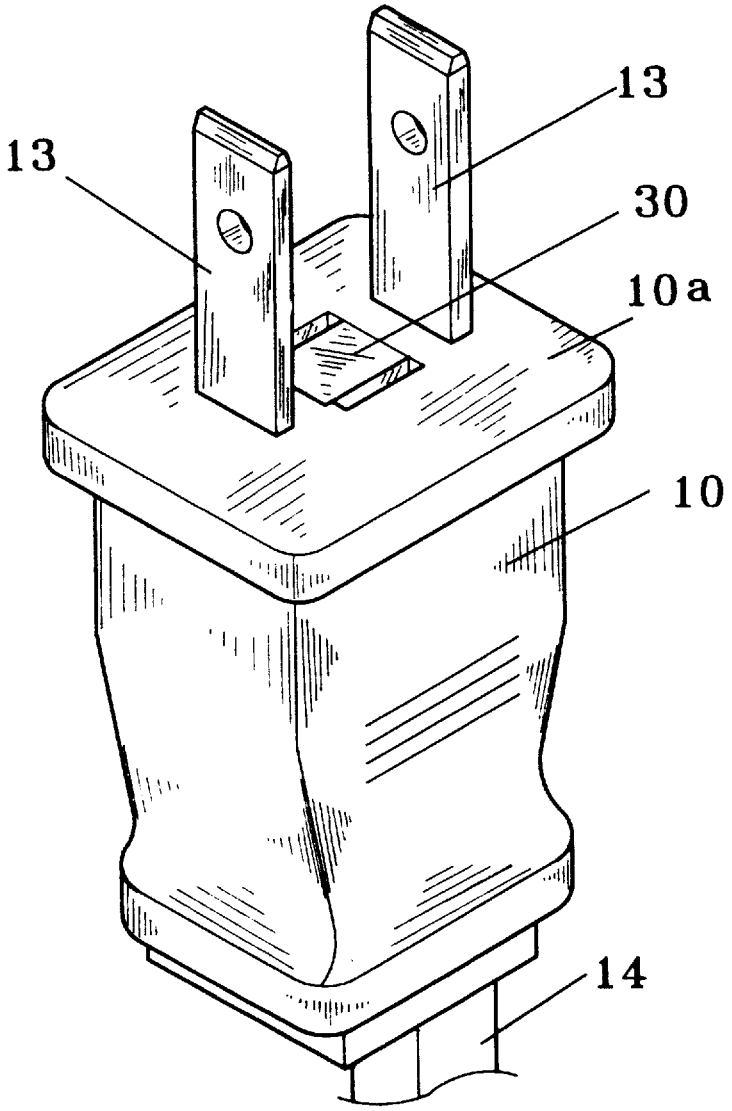
FIG. 3 is a perspective view of the plug in accordance with the present invention.

Referring to FIGS. 1, 2, and 4, an upper lid 30 is removably mounted to the access 210 of the main casing body 21 and includes two snapping fasteners 32, 33 respectively formed on two ends of an underside thereof, each snapping fastener 32, 33 having a snapping end 320, 330. A periphery defining the access 210 includes a stepped section (FIG. 1) to releasably receive the snapping ends 320, 330. The upper lid 30 further includes a central stem 34 (FIG. 4) extending downwardly from the underside of the upper lid 30 to bias the fuse 15 downwardly so as to be in reliable electrical connection with the first and second conductive ends 15*a* and 15*b* of the fuse 15. The upper lid 30 further includes a wedge 31 extending downwardly from the underside thereof, while the periphery defining the access 210 includes an inclined surface (not labeled) to provide a guiding function and to provide a tight engagement therebetween, best shown in FIG. 4.

Referring to FIGS. 1 and 4, the side opening 212 includes an upper recessed section 213*a* and a lower recessed section 213*b*, in which the upper recessed section 213*a* includes an inclined surface 2130, while the side lid 22 includes a complimentary inclined surface 220 to fittingly engage with the upper recessed section 213*a*.

In assembly and manufacture, the first and second conductive pieces 12*a* and 12*b* are respectively mounted in the first and second guide ducts 211*a* and 211*b*, in which the first blade 13*a* integral with the first conductive piece 12*a* extends beyond the housing 10 via the respective passage 214*a*, and the second conductive piece 12*b* is electrically connected to the first wire 14*a*. Then, the second blade 13*b* is extended through the respective passage 214*b* and thus is retained in position. The second wire 14*b* is then electrically connected to the second blade 13*b*. Thereafter, the side lid 22 is attached to the side opening 212 of the main casing body 21. The main casing body 21, the side lid 22, and the blades 13*a*, 13*b* are then placed in a mold and plastic material is injected into the mold to form the housing 10 to thereby enclose the main casing body 21 and the side lid 22. The access 210 of the main casing body 21 allows replacement of the fuse 15 after the upper lid 30 is removed.

According to the above description, it is appreciated that the structure of the plug with a fuse therein is simpler than conventional designs and is easy in manufacture and assembly, especially in the provision of the inclined surface 2130 of the main casing body 21 and the complimentary surface 220 of the side lid 22.

Although the invention has been explained in relation to its preferred embodiment, it is to be understood that many other possible modifications and variations can be made without departing from the spirit and scope of the invention as hereinafter claimed.

What is claimed is:

1. A plug comprising:

a housing having a first compartment defined therein, the housing including an end face through which first and second blades extend and which has an opening defined therein in communication with the compartment, a fuse casing mounted in the first compartment and including a main casing body having an access defined in an upper side thereof through which a fuse is passable and a side opening defined in a side thereof and a side lid removably mounted to the side opening, a periphery defining the side opening of the main casing body including a recessed section with an inclined surface, and the side lid including a complimentary inclined surface to fittingly engage with the inclined surface of the main casing body, a first wire, a second wire in electrical connection with the second blade, a first conductive piece mounted to the fuse casing and in electrical connection with the fuse and the first blade, a second conductive piece mounted to the fuse casing and in electrical connection with the fuse and the first wire, and an upper lid removably mounted to the end face to cover the opening.

* * * * *